US007762745B1

(12) United States Patent
Burchland

(10) Patent No.: US 7,762,745 B1
(45) Date of Patent: Jul. 27, 2010

(54) SILT FENCE INSTALLER

(76) Inventor: Aaron Burchland, 3351 Yates Ave., Gilman, IA (US) 50106

( * ) Notice: Subject to any disclaimer, the term of this patent is extended or adjusted under 35 U.S.C. 154(b) by 709 days.

(21) Appl. No.: 11/582,667

(22) Filed: Oct. 18, 2006

(51) Int. Cl.
*E02D 17/20* (2006.01)
*E02D 17/13* (2006.01)

(52) U.S. Cl. ..... 405/302.6; 405/116; 405/183; 405/302.7; 37/366; 37/367; 172/720

(58) Field of Classification Search ..... 405/302.6, 405/302.7, 116, 183; 256/12.5; 37/367, 37/370, 372, 380; 172/699, 720
See application file for complete search history.

(56) References Cited

U.S. PATENT DOCUMENTS 2,590,385 A * 3/1952 Devereaux ..... 280/447
3,182,459 A 5/1965 Grether et al.
5,915,878 A 6/1999 Carpenter
6,158,923 A * 12/2000 Wheeler et al. ..... 405/302.6
D502,470 S 3/2005 McCormick
D504,134 S 4/2005 McCormick
7,044,689 B1 5/2006 McCormick
2003/0132605 A1* 7/2003 Wiers ..... 280/468

* cited by examiner

*Primary Examiner*—David J Bagnell
*Assistant Examiner*—Benjamin Fiorello
(74) *Attorney, Agent, or Firm*—Camille L. Urban; G. Brian Pingel

(57) ABSTRACT

The present invention is a silt fence installer of unique design wherein the frame is angular rather than longitudinal and the fabric chute assembly is oriented parallel with the angular frame. This arrangement results in an installer with a generally perpendicular trailing edge, a fabric chute assembly with a closed leading edge and no need for hinged relationship between the sidewalls, and simple fabric threading with a single directional turn of the fabric. Further, the angular frame results in a shorter installer able to be more responsive to turns. In addition, the invention includes a sliding offset hitch wherein a silt fence installer may be adjusted laterally by hand due to strategic placement of rollers.

23 Claims, 11 Drawing Sheets

SILT FENCE INSTALLER

BACKGROUND OF THE INVENTION

1. Field of the Invention

Many construction projects result in sloped areas without ground covering such as plants. Agricultural fields also may include sloping areas. These sloped generally bare areas will erode drastically with time and weather unless they are equipped with conservation tools. Various implements have been devised by which a fabric-like fence can be partially inserted in a soil furrow and secures by posts and the like. The fence acts to reduce the erosion of the soil from above the fence and stop it there. Several fences may be required in a single sloped area.

2. Background of the Invention

U.S. Pat. No. 3,182,459 to Grether provides an installer mounted on the side of a tractor and which automatically adds the posts. This installer includes a fabric chute employing at least one rod as a pivotal directions changer for the fabric.

U.S. Pat. No. 5,915,878 to Carpenter provides an installer wherein the fabric is positioned transverse to the direction of travel and is inserted partially in a furrow by a wheel.

U.S. Pat. Nos. D502,470, D504,134, 7,044,689 to McCormick provide a pull-behind installer having a longitudinal frame, a plow element and a fabric chute. The fabric chute is designed to require the fabric to successfully make two turns with the fabric, the second while exiting the leading edge of the chute and turning so the fabric is deposited in the furrow made by the plow element. This design requires the leading edge to be perpendicular to the longitudinal frame and includes a rod at a 45 degree angle from the leading edge around which the fabric makes the first turn so the fabric direction is turned forward, then out the leading edge and a 180 degree second turn to reverse its direction. For threading the fabric, the chute is made of separate plates hinged together on one side so the chute can be opened and closed easily. The direction and position of entry and exit of the fabric are such that the 45 degree angle must be at the trailing edge in order to allow the chute to be opened and threaded and cleaned and the leading edge must be about perpendicular with the ground to provide appropriate alignment of the fabric into the furrow. This arrangement requires a deflector for the front exit slot of the chute to keep dirt out of the chute which may otherwise impede the flow of the fabric. In short, two direction changing rods and two plates hingedly connected on one side are necessary for this installer to function properly. One version of this plow allows the frame to pivot relative to the mounting bracket; another allows a tongue and plow to pivot on the frame steadied by springs.

In addition to dirt lodging in the chute and the necessity of complex structures to allow ease of fabric threading, earlier silt fence installers are plagued with other common problems. Among these problems are a deficit for sharp turns and a lack of versatility for lateral adjustment relative to the mount on the towing vehicle. In addition, the arm upon which the fabric roll rotates is vertically fixed and the deflector adds drag as the installer is moved through the soil. It is therefore one object of the present invention to avoid problems related to dirt in the fabric chute. A second object is to simplify the chute structure and yet increase the ease of threading. A third objective is to structure an installer that is both stronger yet more agile and responsive. A fourth objective is to decrease the drag from that resulting from the use of the regular sized installer and that caused by employing a deflector. The final objective is to provide an installer with a hitch mechanism to allow lateral adjustment.

SUMMARY OF THE INVENTION

The present invention resolves many of the issues present in prior art silt fence installers. First, it provides a simpler fabric chute constructed with fewer pieces which does not require a hinged opening, requires a single change in direction of the fabric, and negates the need for a deflector. This construction also decreases the incidence of fabric tears and tension. Second, the present invention is laterally adjustable relative to the vehicle towing it. Third, this installer follows the turns of the towing vehicle and meets the need for tighter curves while increasing the structural strength of the installer. Fourth, the present invention provides a vertically adjustable fabric roll holder to accommodate varying dimensions of fabric rolls. Fifth, the preferred embodiment is smaller than a typical installer yet it can be used to install fabric 48 inches wide or less.

The installer of the present invention relies on a frame assembly having a main angular frame support affixed to at least one vertically oriented frame member. The vertically oriented frame member has a hitching side for associating with a hitch assembly and a mounting side associated with the angular support. Preferably, the vertically oriented frame member is pivotally associated on its hitching side with a sliding offset assembly which is, in turn, mounted on a sliding offset hitch. Due to the use of rollers in the sliding hitch, no hydraulic power is necessary to adjust the position of the installer on the hitch relative to the vehicle. The hitching side may alternatively be associated with a three point assembly or forklift assembly.

The upper portion of the angular support is associated with the vertically oriented frame member while the lower portion is associated on its leading side with a blade assembly and on its trailing side with a fabric chute assembly. A coulter assembly is attached to a bottom side of the vertically oriented frame member through an association provided by a coulter bracket assembly.

The fabric chute assembly comprises a first and a second vertical plate-like sidewall each joined to the other at the bottom but maintaining a small space therebetween. The first and second sidewalls are affixed to the trailing edge of the blade assembly. The top edges of the first and second sidewalls remain separate forming an entry slot as do the trailing edge of the first and second plates forming an exit slot. The sidewalls may be formed integrally with one another or may be affixed to one another through means known in the art such as welds. In either arrangement, there is no gap between the sidewalls on their leading edges. The leading edge of the chute assembly is generally parallel to the angle of the angular support and associated with the support's lower portion. The trailing edge of the chute assembly is generally vertical. A rod, parallel to the angle of the angular support is positioned near the leading edge of the chute assembly between the first and second plates for a purpose to be described later.

Protruding from the vertically oriented frame member is a roll stand assembly which has a vertical support to which is attached a horizontal fabric roll support. The fabric roll support is oriented along the axis of travel and generally above the fabric chute assembly. A roll of fabric is rotatably associated with the support. The vertical height of the horizontal fabric roll support is adjustable.

To thread the fabric, it is unrolled to extend into the entry slot between the first and second sidewall at their top edges, threaded under the rod near the chute assembly's leading edge which acts to convert the vertical orientation of the fabric's travel to horizontal, and then out the exit slot formed by the trailing edges of sidewalls.

The chute assembly construction relative to the direction of travel negates the need for a deflector because the leading edge of the chute is closed rather than open. Further, because only a single rod is used, the fabric is easily threaded without separating the plates so the first and second sidewalls can be integrally formed or, at the least, require no hinged or pivotal relationships to each other. This greatly simplifies the chute's construction. In addition, this arrangement simplifies threading the fabric and reduces tension on the fabric resulting in fewer tears than other installers.

The angular support coupled with the generally vertically oriented frame member increases the strength of the frame against horizontal moment, further simplifies the overall frame structure and dramatically shortens the installer from leading to trailing edge. Shortening the installer results in making its turns more closely reflective of those of the towing vehicle to which it is attached. In the preferred embodiment, the frame assembly is more clearly described wherein the vertically oriented frame member comprises two parallel planar elements joined at their bottom edges by a horizontal bar and between which is sandwiched the angular support. In this arrangement, the coulter bracket and assembly are affixed to the bottom side of the bar.

The frame assembly is pivotally associated with the hitch assembly on the hitching side of the generally vertically oriented frame member further allowing more responsive turns of the plow. The installer is biased toward a center alignment relative to the hitch by a lateral spring on either side of the means for associating said frame and said hitch.

In operation, the hitch assembly may be associated with a skid steer adaptor and skid loader, a three-point hitch and towing vehicle, a sliding offset hitch and towing vehicle, or other means to associate the installer with a mobile power unit. Preferably, the installer is associated with a sliding offset hitch.

The sliding offset hitch assembly includes an offset frame having an upper lateral support with a rearward side, a bottom side and a forward extending portion to which the top in of a three point hitch can be attached.

The upper lateral support is spaced vertically from two lower lateral supports each having a front side and a rearward side, all positioned between two vertical end plates. A forward plate extends at least partially along the length of each of the lower lateral supports and covers the gap between the two lower lateral supports. The forward plate is associated with a pair of brackets, laterally spaced apart, having openings through which the two bottom pins of a three point hitch will extend.

A sliding offset bracket assembly is associated on one side with the hitch assembly of the installer and on its opposing side with the offset frame. The opposing side of the sliding offset bracket assembly includes a forward extending portion. This forward extending portion is inserted between the first and second lower lateral supports. The forward extending portion is equipped with rollers to turn vertically against the bottom side of the first lower lateral support and the top side of the second lower lateral support and rollers to turn horizontally against the back side of the first lateral support. The positioning of the rollers allows the sliding offset bracket assembly to be slidably associated with the sliding offset hitch assembly such that an operator can adjust the lateral position of the installer by hand and without the need for hydraulic or other powered assistance.

In the preferred embodiment an adjustment bar is proximal the bottom side of the upper lateral support. The adjustment bar includes laterally spaced apart openings. A pin inserted in an opening on the bracket through the bracket and into one of the laterally spaced apart openings secures the offset bracket assembly in position relative to the sliding offset hitch assembly.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DETAILED DESCRIPTION OF THE PREFERRED EMBODIMENT

Figure 1:
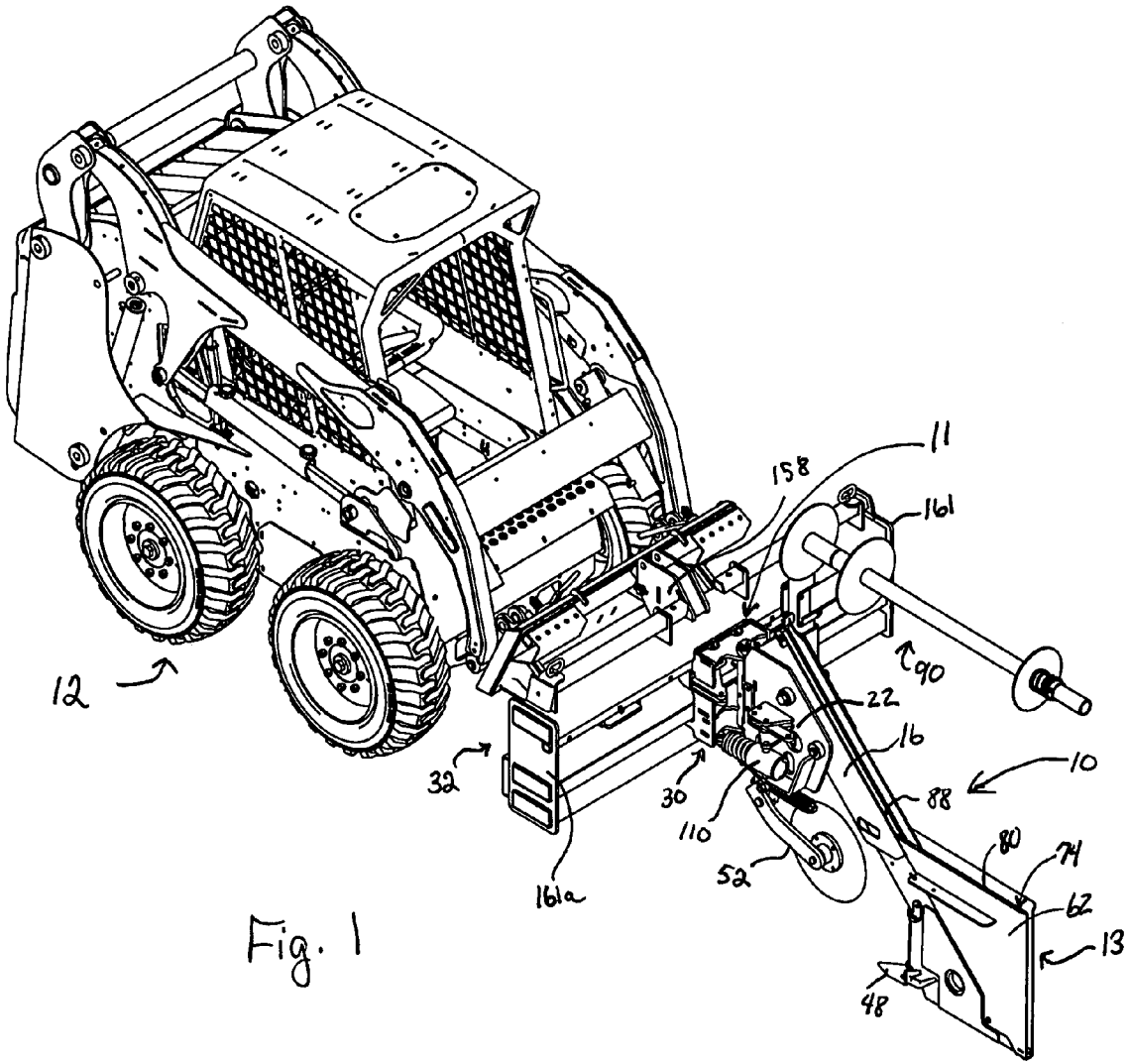
FIG. 1 is a perspective of the installer of the present invention attached to a power and transport source.
Figure 2:
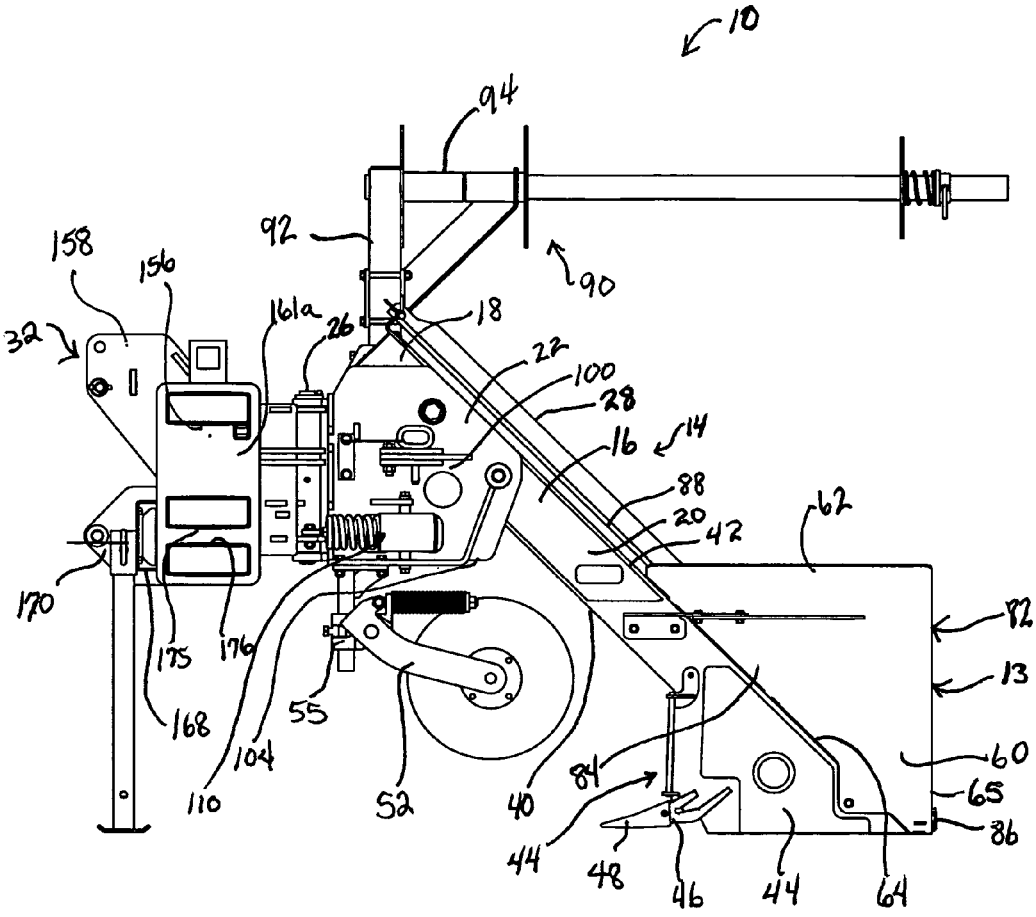
FIG. 2 is a side view of the installer of the present invention associated with a sliding offset hitch.
Figure 2A:
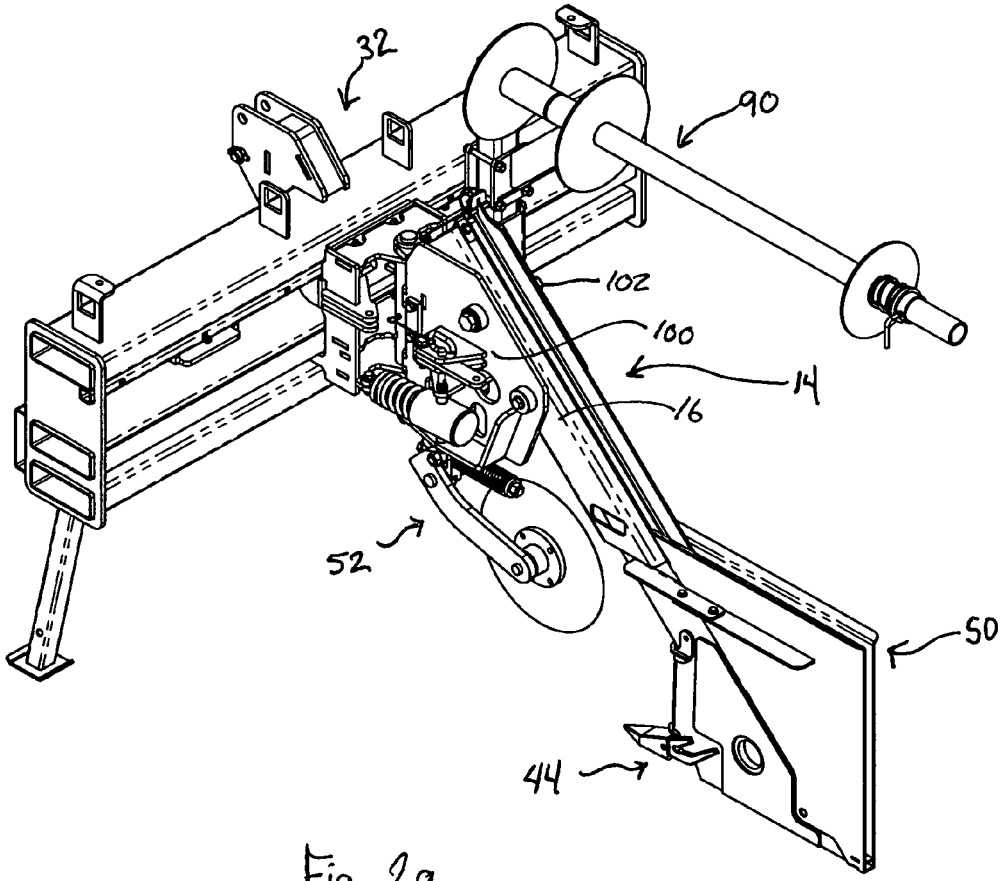
FIG. 2*a* perspective of the installer of FIG. 2.
Figure 3:
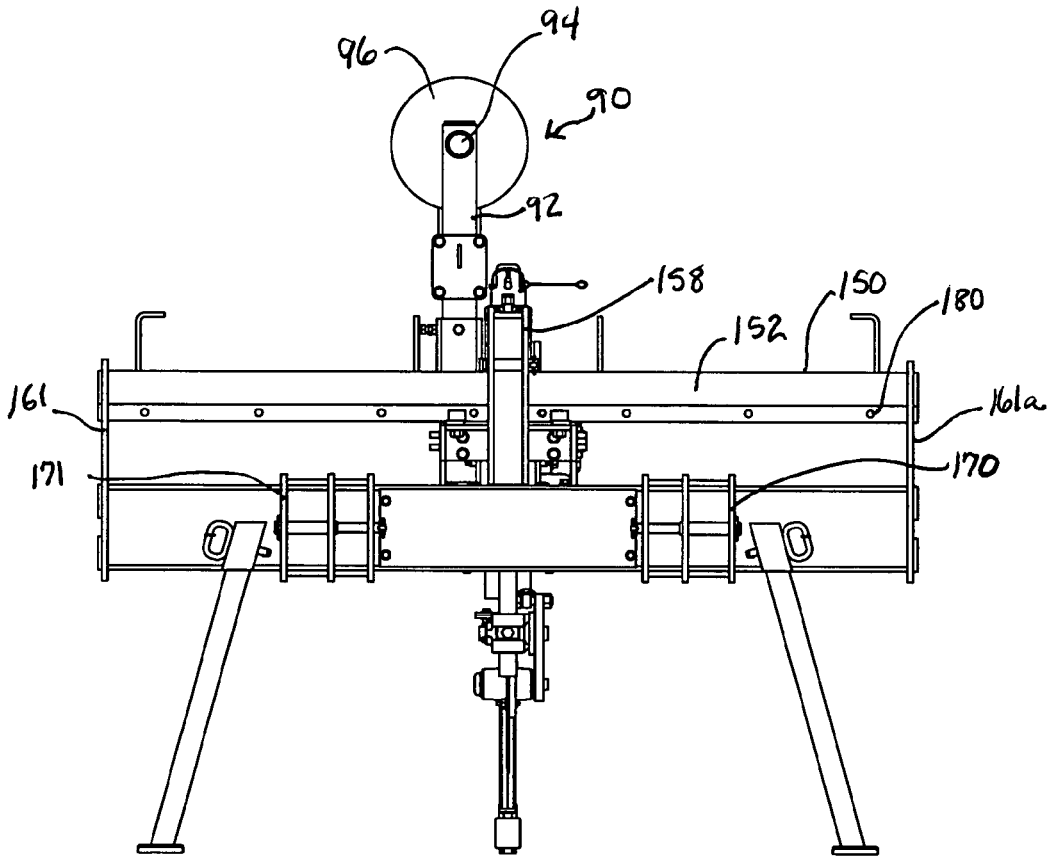
FIG. 3 is a front end view of the installer of the present invention associated with a sliding offset hitch.
Figure 4:
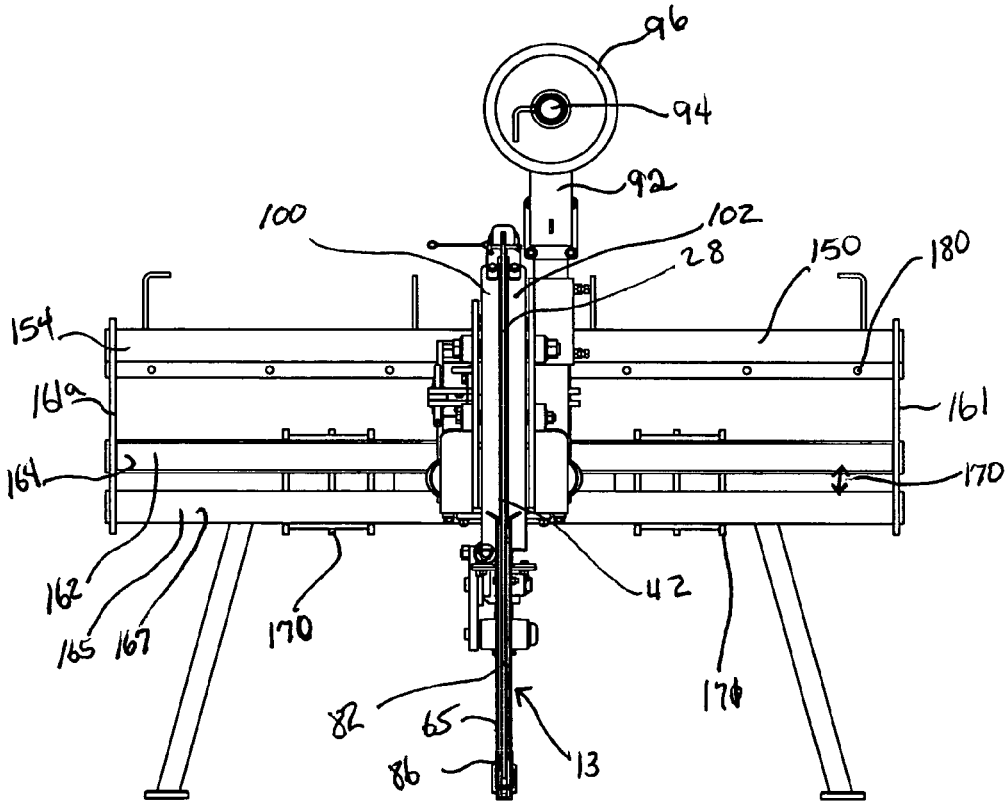
FIG. 4 is a back end view of the installer of FIG. 3.
Figure 5:
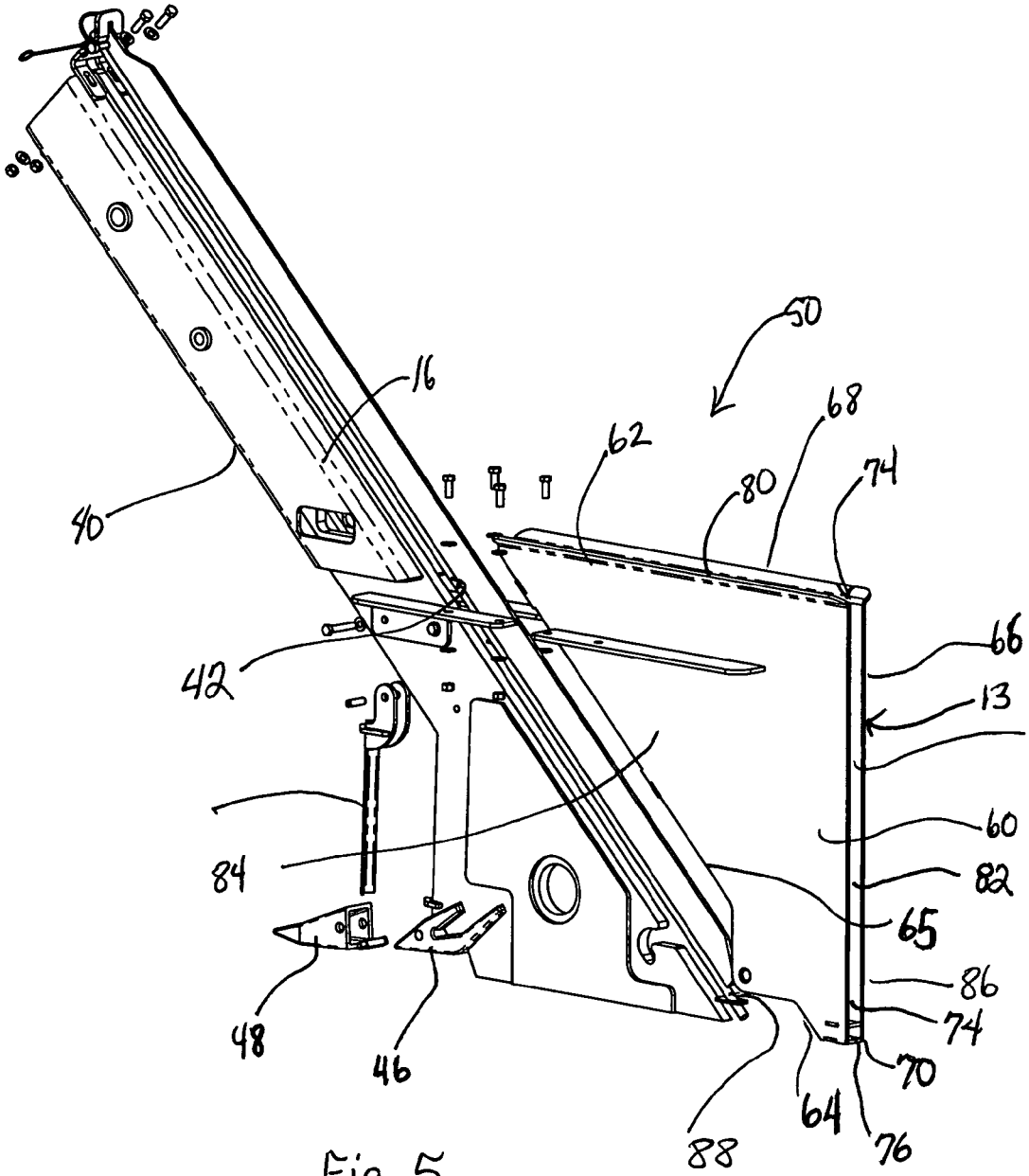
FIG. 5 is an exploded view of the angular support and chute assembly of the present invention.
Figure 6:
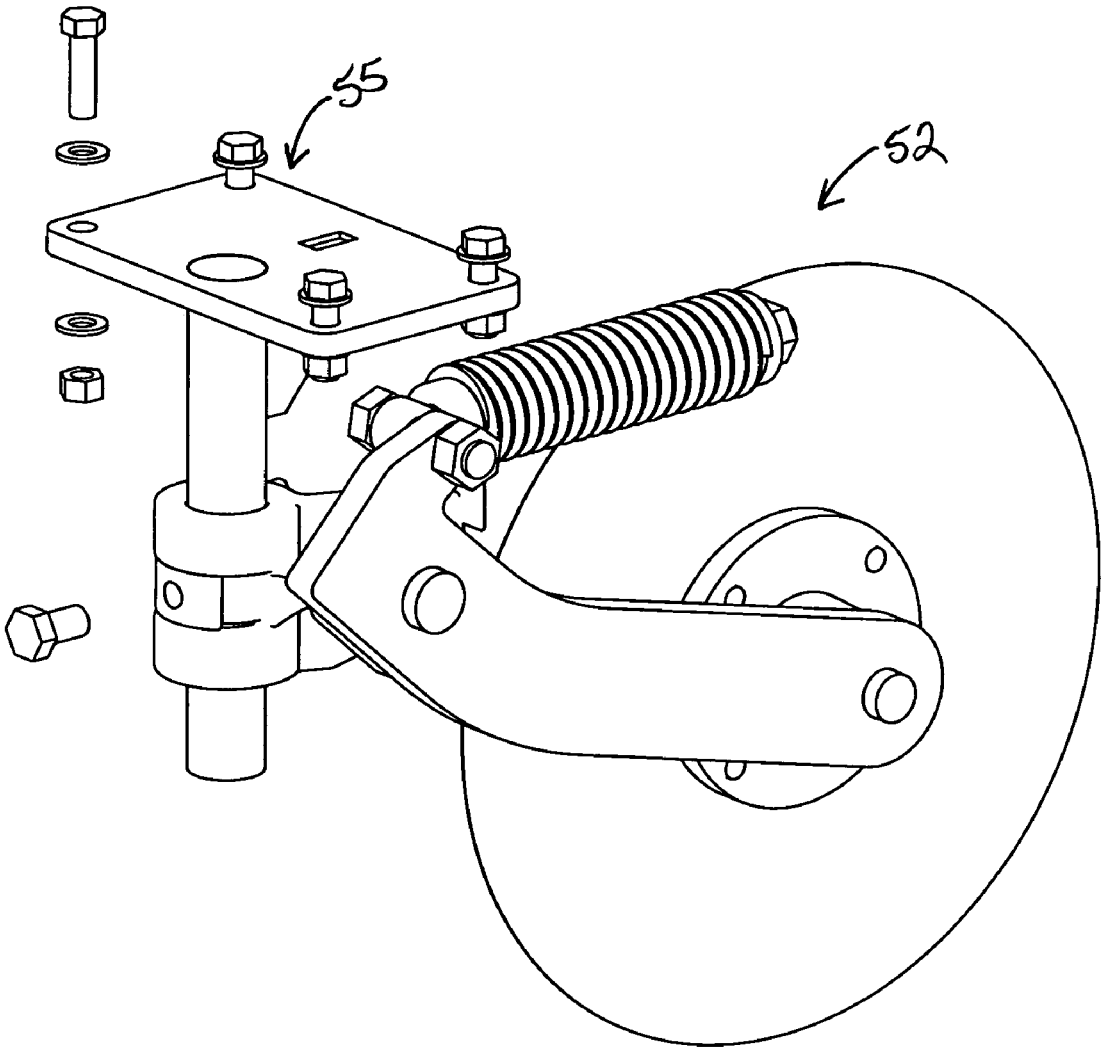
FIG. 6 is a close-up perspective of the coulter assembly and coulter bracket.
Figure 7:
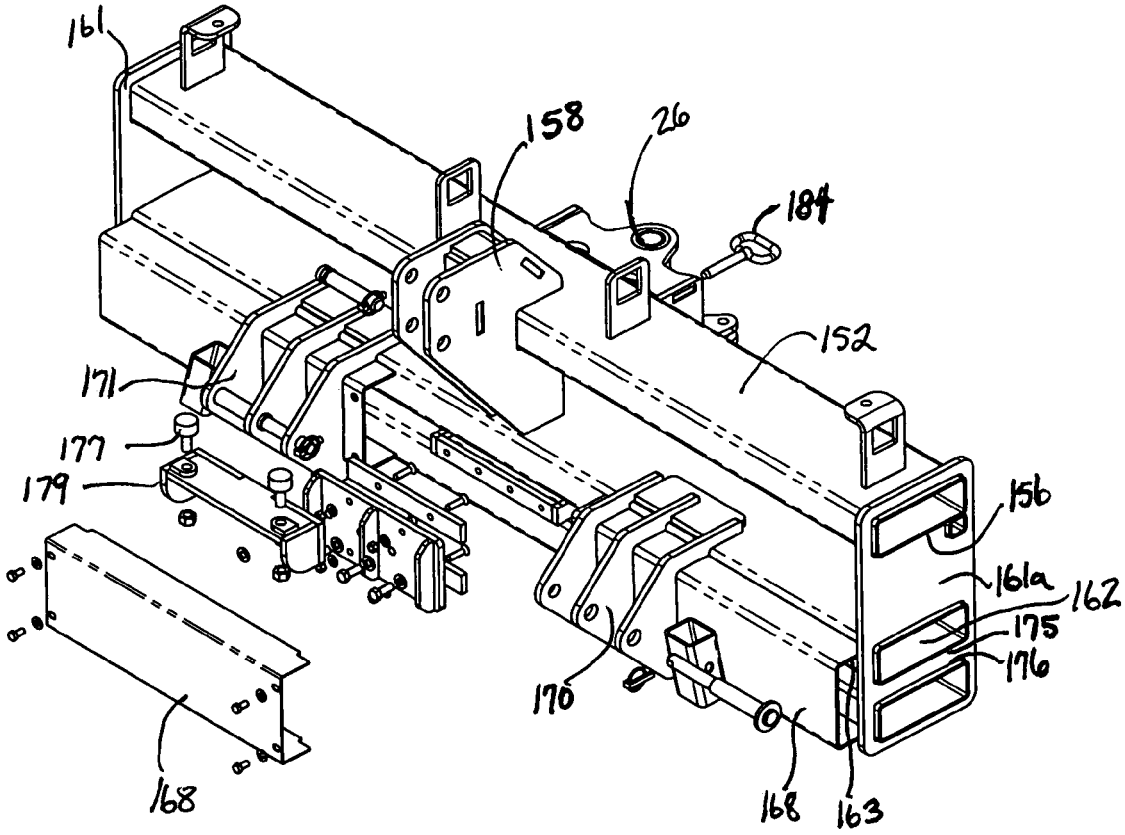
FIG. 7 is a perspective view of the front of the sliding offset hitch assembly.
Figure 8:
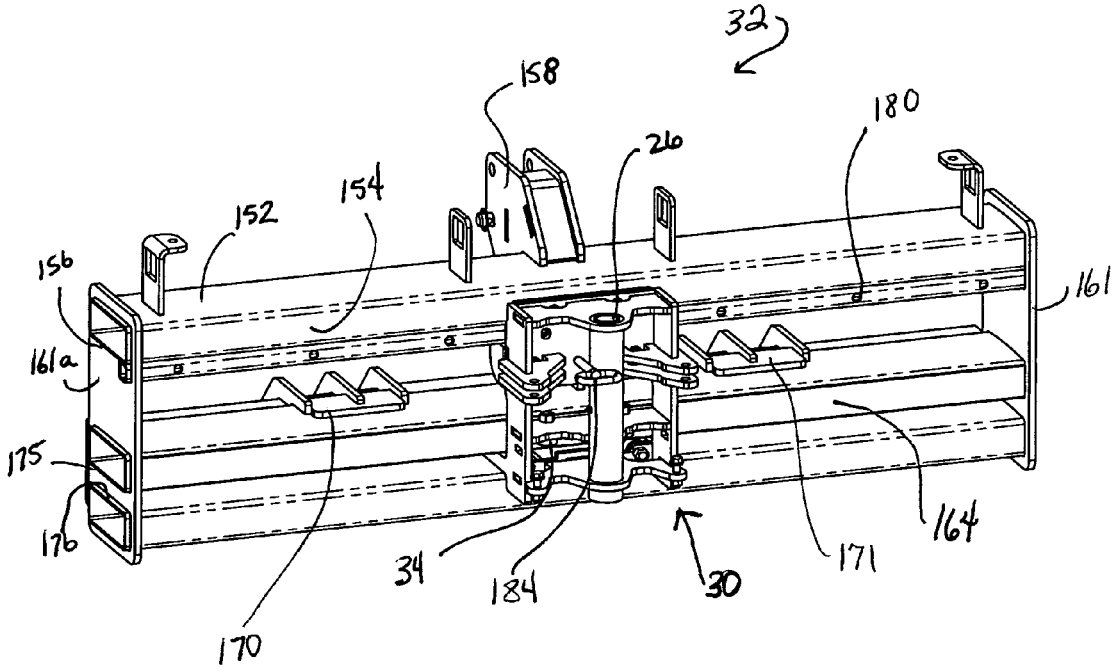
FIG. 8 is a perspective view from the back of the sliding offset hitch assembly.
Figure 9:
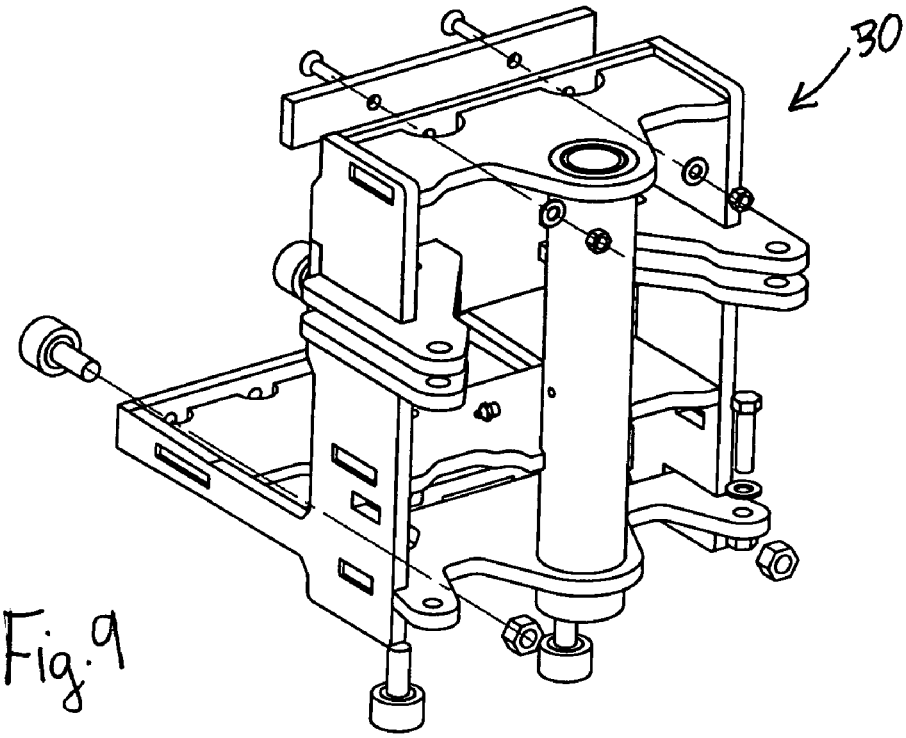
FIG. 9 is an exploded back view of the sliding offset bracket assembly.
Figure 10:
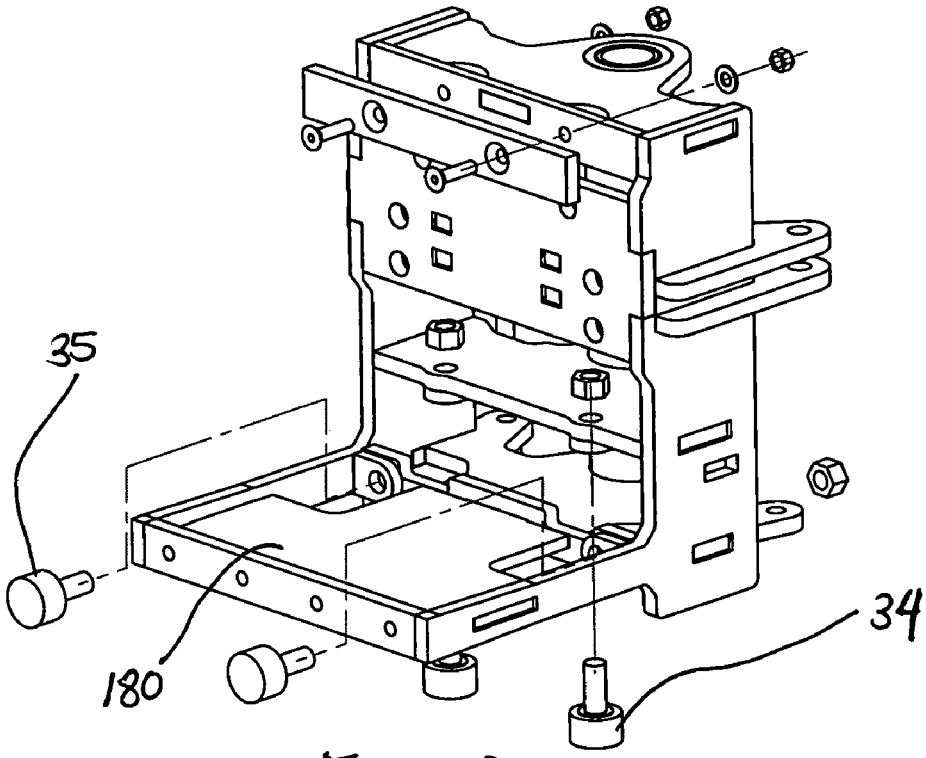
FIG. 10 is an exploded front view of the sliding offset bracket assembly.
Figure 11:
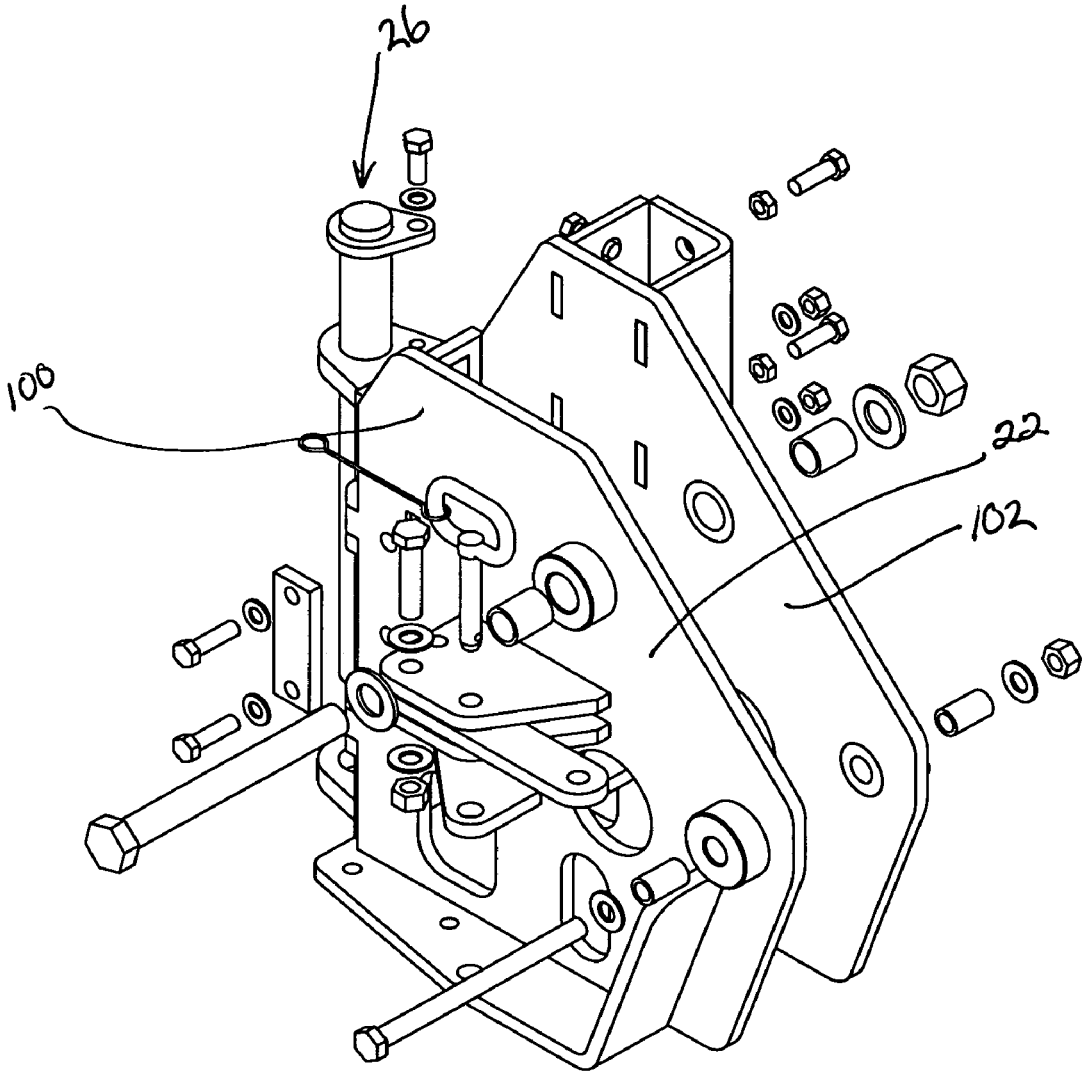
FIG. 11 is an exploded, enlarged view of the at least one vertically oriented frame member of the frame assembly of the preferred embodiment.

Referring now to FIG. 1, a perspective of the installer 10 of the present invention having a leading edge 11 and a trailing edge 13 is shown hitched to a towing vehicle 12. Shown in more detail in FIGS. 2-5, the installer 10 of the present invention relies on a frame assembly 14 having a main angular frame support 16 comprising an upper portion 18 and a lower portion 20 said support 16 is affixed to at least one vertically oriented frame member 22 comprising a hitching side 24 equipped with means for associating a hitch assembly 26 and a mounting side 28. The vertically oriented frame member 22 is pivotally associated by said means for associating a hitch assembly 26 with a sliding offset bracket assembly 30 which is, in turn, slidably mounted on a sliding offset hitch 32. Due to the use of rollers 34 and 35 (See FIG. 7) in the sliding offset bracket assembly 30, no hydraulic power is necessary to adjust the position of the installer 10 on the hitch 32 relative to the vehicle 12. In another embodiment, the at least one vertically oriented frame member 22 is pivotally associated by said means for associating a hitch assembly 26 with a 3-point assembly.

The upper portion 18 of the angular frame support 16 is associated with the at least one vertically oriented frame member 22 while the lower portion 20 further comprises a leading side 40 and a trailing side 42 and is associated on the leading side 40 with a blade assembly 44 having a blade 46 and a tooth 48 and on its trailing side 42 associated with a fabric chute assembly 50. A coulter assembly 52 is attached to a bottom, generally horizontal side 54 of the at least one vertically oriented frame member 22 through an association provided by a coulter bracket assembly 55.

The fabric chute assembly 50 comprises a first vertical sidewall 60 having a first top edge 62, a first bottom edge 64, and a first trailing edge 65, and a second vertical sidewall 66 having a second top edge 68, a second bottom edge 70 and a second trailing edge 72 with a small space 74 between said first sidewall 60 and the second sidewall 66. In one embodiment, the first and second sidewall 60, 66 respectively, are joined together by a flange 76 at the bottom edge 64, 70 respectively, of each sidewall 60,66 respectively, and to the trailing edge 42 of the blade assembly 44. The top edges 62, 68 respectively of the first 60 and second 66 sidewall remain separate forming an entry slot 80 as do the trailing edge 65, 70 respectively of the first 60 and second 66 sidewall forming an exit slot 82. In another embodiment, the sidewalls 60, 66 and flange 76 may be integral to one another such that the structure is of a single piece or may be affixed to one another through means known in the art such as welds.

A leading edge 84 of the chute assembly 50 is positioned generally parallel to the angle of the angular support 16 and associated with the support's 16 lower portion 20. The chute assembly 50 further comprises a trailing edge 86 which is generally vertical. A rod 88, parallel to the angle of the leading edge 84 and the angular support 16 is positioned near the leading edge 84 of the chute assembly 50 between the first 60 and second 66 sidewalls for a purpose to be described later.

Protruding from the at least one vertically oriented frame member 22 is a roll stand assembly 90 comprising a vertical support 92 to which is attached a horizontal fabric roll support 94. The fabric roll support 94 is oriented along the axis of travel and generally above the fabric chute assembly 50. A roll of fabric 96 is rotatably associated with the support 94 and fabric 96 is unrolled to extend into the entry slot 80 between the first 60 and second 66 sidewall sides, threaded under the rod 88 which acts to convert the vertical orientation of the fabric's travel to horizontal, and then out the exit slot 82 on the trailing edge 86.

The chute assembly 50 construction relative to the direction of travel negates the need for a deflector because the leading edge 84 of the chute is closed rather than open. Further, because the fabric 96 is easily threaded without separating the sidewalls 60, 66, the first 60 and second 66 sidewalls can be integrally formed or, at the least, require no hinged or pivotal relationships to each other since there is no need to open the sidewalls. The angular support 16 coupled with the generally vertically oriented frame member 22 increases the strength of the frame assembly 14 against horizontal moment, simplifies the construction and dramatically shortens the installer 10 from leading 11 to trailing edge 13 making its turns more closely reflective of those of the towing vehicle 12 to which it is attached. In the preferred embodiment, the frame assembly 14 is more clearly described wherein the at least one generally vertically oriented frame member 22 comprises a first parallel planar elements 100 and a second parallel planar element 102 joined by a horizontal bar 104. Between the first planar element 100 and the second planar element 102 is sandwiched the angular support 16. The coulter bracket 52 and coulter assembly 54 are affixed to a bottom side 105 of the bar 104.

The frame assembly 14 is pivotally associated with the hitch 32 further allowing more responsive turns of the plow. The installer 10 is biased toward a center alignment with said means for associating said assembly 26 by a lateral spring 110 on either side of the means for associating said hitch assembly 26.

The installer 10 may be removably attached through its means for associating said hitch assembly to a three-point hitch 140, a skid loader, a sliding offset hitch, or other means allowing the installer to be towed by a power unit. In one preferred embodiment, the sliding offset hitch 32 comprising the sliding offset bracket assembly 30 and an offset frame 150 is associated with said means for associating a hitch assembly 26 on said installer 10.

The offset frame 150 comprises an upper lateral support 152 with a rearward side 154, a bottom side 156, and a forward extending portion 158 to which the top pin 4-60 of a three point hitch can be attached.

The upper lateral support 152 is spaced vertically from a first lower lateral support 162 having a first front side 163 and a rearward side 164 and a second lower lateral support 165 having a second front side 166 and a second rearward side 167. Said first lower 162 and said second lower lateral support 165 are positioned between two vertical end plates 161, 161*a* respectively. A forward plate-like element 168 extends along said first front side 163 and said second front side 166 to at least partially cover a gap 170 between said first lower lateral support 162 and said second lower lateral support 165. Preferably, the forward plate-like element 168 comprises a pair of brackets 170, 171, respectively. These brackets 170, 171 include elements whereby the bottom two pins 172, 174 of a three point hitch 140 are associated.

The sliding offset bracket assembly 30 is associated with said means for associating a hitch assembly 26 of the installer 10 and with the offset frame 150. Said first lower lateral support 162 further comprises an under side 175; said second lower lateral support 165 further comprises a top side 176.

The offset bracket assembly 30 comprises a forward extending portion 180. The forward extending portion 180 is inserted in the gap 170 and is equipped with at least one roller 34 having a vertical axis and at least one roller 35 having a horizontal axis. Said at least one roller 34 with vertical axes are positioned to roll along said rearward side 164 of said first lower lateral support 162 and said at least one roller 35 having horizontal axes are positioned to roll along between said under side 175 and said top side 176. At least one roller 177 having a vertical axis is attached to a roller bracket 179. Said roller bracket 179 is positioned on the opposite side of gap 170 from the forward extending portion 180 and attached thereto such that said at least one roller 177 rolls against the front side 163 of said first lower lateral support 162 further facilitating the sliding of the bracket assembly 30 while keeping its position generally constant in the leading to trailing direction relative to said frame 150. The forward plate-like element 168 is positioned to act as a dirt guard for the roller bracket 179 and rollers 177.

The lateral position of the sliding offset bracket assembly 30 may be adjusted by hand. A plurality of openings 180 are spaced apart laterally proximal said rearward side 154 of said upper lateral support 152. An opening 182 in said bracket assembly 30 is aligned with one of said plurality of openings 180, a pin 184 is then inserted through said opening 182 and opening 180 to secure the position of the sliding offset bracket assembly on said offset frame. Adjustment of lateral position is simple; the pin is removed, the rollers allow sliding of the installer by hand, the openings 182 and 180 are aligned and the pin is re-inserted.

Thus, the present invention has been described in an illustrative manner. It is to be understood that the terminology that has been used is intended to be in the nature of words of description rather than of limitation.

Many modifications and variations of the present invention are possible in light of the above teachings. For example, a single roller with a horizontal axis may be used although the lateral adjustment of the installer may not be as simple. A single roller may best be used with a track in one or the other lower lateral supports to keep the roller positioned. As another example, the sidewalls of the chute may be integral with one another or they may each be separately attached to the angular support thereby closing any gap that would otherwise occur at their leading edges. The forward plate-like element that covers the gap between the first and second lower lateral supports and protects the roller bracket could be left off completely without significantly changing the invention. However, its presence maximizes protection of the rollers and minimizes what would otherwise be required maintenance. Further, it should be understood that the generally right angle formed with the ground by the trailing edge of the chute assembly is not critical to the operation of the installer; other angles may be used. In addition, although not required, a wind guard may be attached above the chute assembly and below the roller to assist in minimizing any ill effect a strong wind may have on the threading of the fabric and operation of the installer. Therefore, within the scope of the appended claims, the present invention may be practiced otherwise than as specifically described.

What is claimed is:

1. A silt fence installer comprising:

a) an angular frame assembly comprising a main angular, non-horizontal support having an upper portion, a lower portion, a leading side and a trailing side said frame assembly further comprising a generally vertically oriented frame member associated with the upper portion of said main angular support and having means for associating a hitch assembly;

b) a blade assembly associated with the lower portion of said main angular support;

c) a fabric chute assembly comprising a generally horizontally oriented roll of silt fence material, an exit slot between a trailing edge of a first sidewall and a trailing edge of a second sidewall, a leading edge generally parallel to and affixed to the trailing side of said main angular support wherein both said trailing side of said angular support and said leading edge of said chute assembly are angled upward from horizontal.

2. The silt fence installer of claim 1 wherein the fabric chute assembly further comprises said first sidewall having a first top edge, and a first bottom edge said second sidewall having a second top edge, and a second bottom edge, a space between said first and said second sidewalls, a flange joining said first bottom edge and said second bottom edge, an entry slot, and a rod.

3. The silt fence installer claimed in claim 2 wherein said entry slot comprises a space between said first top edge and said second top edge and said exit slot is generally vertical.

4. The silt fence installer claimed in claim 1 wherein said generally vertically oriented frame member comprises a mounting side, a first planar element affixed to the upper portion of the angular frame support, and a hitching side.

5. The silt fence installer claimed in claim 4 wherein said generally vertically oriented frame member further comprises a second planar element affixed to the upper portion of the angular frame support wherein said first planar element and said second planar element are spaced apart and substantially parallel with the angular frame support positioned therebetween.

6. A silt fence installer comprising:

a) an angular frame assembly comprising a main angular support wherein said assembly has a trailing edge generally parallel to the support and at least one generally vertically oriented frame member;

b) a fabric chute assembly comprising a length of fabric oriented in a first direction, a leading edge, a trailing edge, a first generally planar side a second generally planar side, and a space therebetween said fabric chute assembly further comprising means for reversing said first direction of said length of fabric;

c) said leading edge of the fabric chute assembly generally parallel to and affixed to said trailing edge of the angular support;

d) said trailing edge of the chute assembly generally perpendicular to horizontal; and e) said vertically oriented frame member comprising a hitching side having means for associating a hitch assembly.

7. The silt fence installer of claim 6 wherein said means for associating a hitch assembly comprises at least one opening through which a pin may be inserted and said hitch assembly comprises a sliding offset hitch.

8. The installer claimed in claim 7 wherein said sliding offset hitch comprises an offset frame and a sliding offset bracket assembly.

9. The installer of claim 8 wherein said offset frame comprises a first lateral support having a rearward side, an underside, and a front side, and a second lateral support having a top side, said sliding offset bracket assembly slidingly associated with said first and said second lateral support, by at least one roller having a horizontal axis and associated with said assembly.

10. The installer of claim 9 wherein said sliding offset bracket assembly comprises a forward extending portion inserted between said first and second lateral supports from the rearward side and further comprises a roller bracket associated with the forward extending portion proximal the front of said first lateral support.

11. The installer of claim 10 wherein said sliding offset bracket assembly further comprises at least one roller having a vertical axis, said roller in contact with the rearward side of said first lateral support, the at least one said roller having a horizontal axis in contact with said underside of the first lateral support and the top side of the second lateral support, and another roller having a vertical axis associated with the roller bracket and in contact with said front side of said first lateral support.

12. The installer of claim 9 wherein said underside of the first lateral support and the top side of the second lateral support are separated by a gap into which a forward extending portion of the assembly is inserted from the rearward side and said forward extending portion further comprises said at least one roller having a horizontal axis, said roller positioned to engage at least one of said top side and said underside.

13. The installer as claimed in claim 12 wherein said offset bracket assembly further comprises a roller bracket positioned near the front side of the first lateral support and associated with the forward extending portion and at least one roller having a vertical axis and positioned to engage said front side.

14. The installer of claim 12 wherein said offset frame further comprises a plurality of laterally spaced apart openings, and said offset bracket assembly further comprises a single opening to be slidably aligned with one of said plurality of laterally spaced apart openings and a pin for securing said offset bracket assembly's lateral position on said offset frame.

15. The installer of claim 12 wherein said offset bracket assembly is associated with means for associating a hitch assembly on the installer.

16. The installer of claim 9 wherein said frame further comprises an upper lateral support, a first vertical end plate and a second vertical end plate.

17. The installer of claim 16 wherein said upper lateral support comprises a forward extending portion to which a hitch may be attached.

18. The installer of claim 6 wherein the trailing edge of said chute assembly comprises an exit slot at said trailing edge of said chute assembly, and said chute assembly further comprises an entry slot.

19. The installer of claim 18 wherein said installer further comprises a roll stand assembly having a vertical support and a horizontal fabric roll support oriented generally above and generally parallel with the entry slot of said chute.

20. The installer of claim 19 wherein said chute assembly further comprises a rod between said first and second generally planar sides positioned substantially parallel to said trailing edge of the angular support for creating a change in direction of fabric threaded around said rod from vertical to horizontal and out said exit slot.

21. A silt fence installer comprising an angular frame assembly having a major axis at an angle between about 20 degrees and about 60 degrees from horizontal and comprising a generally vertically oriented frame member including means for associating a hitch assembly and proximal to and associated with a roll stand assembly, and further comprising a main angular support positioned at the angle of the major axis including a lower portion wherein said lower portion is proximal to and associated with a fabric chute assembly and a blade assembly wherein said fabric chute assembly comprises a first sidewall and a second sidewall, said first sidewall and said second sidewall positioned permanently.

22. The installer of claim 21 wherein said fabric chute assembly comprises a first vertical sidewall having a first top edge and a first trailing edge and a second vertical sidewall having a second top edge and a second trailing edge wherein said first and second sidewalls are joined to form a closed leading edge and a space therebetween, an entry slot comprising said first and said second top edges, and an exit slot comprising said first and said second trailing edges.

23. The installer of claim 21 wherein said angular support further comprises a leading side and a trailing side, said blade assembly comprises a tooth and a blade, said blade assembly associated with the leading side of a lower portion of the angular support, and the fabric chute assembly further comprises a leading edge said leading edge parallel and associated with the trailing side of the lower portion of the angular support.

* * * * *